US010787028B2

(12) United States Patent
Kelley

(10) Patent No.: US 10,787,028 B2
(45) Date of Patent: Sep. 29, 2020

(54) CARRYING CASE FOR WET CANVAS

(71) Applicant: Benjamin Kelley, Oakland, CA (US)

(72) Inventor: Benjamin Kelley, Oakland, CA (US)

( * ) Notice: Subject to any disclaimer, the term of this patent is extended or adjusted under 35 U.S.C. 154(b) by 36 days.

(21) Appl. No.: 16/210,791

(22) Filed: Dec. 5, 2018

(65) Prior Publication Data

US 2019/0176513 A1 Jun. 13, 2019

Related U.S. Application Data

(60) Provisional application No. 62/597,545, filed on Dec. 12, 2017.

(51) Int. Cl.

| | |
|---|---|
| ***B44D 3/00*** | (2006.01) |
| ***B65D 5/52*** | (2006.01) |
| ***A47B 97/08*** | (2006.01) |
| ***B44D 7/00*** | (2006.01) |

(52) U.S. Cl.

CPC ..... *B44D 3/00* (2013.01); *A47B 97/08* (2013.01); *B44D 7/00* (2013.01)

(58) Field of Classification Search

CPC .... B44D 3/00; B44D 3/02; B44D 7/00; A47B 97/08; B65D 5/52; B65D 25/54

USPC ..... 206/1.7, 45.24, 575, 765, 774; 248/448, 248/451, 689

See application file for complete search history.

(56) References Cited

U.S. PATENT DOCUMENTS

| | | | | |
|---|---|---|---|---|
| 1,664,476 | A * | 4/1928 | Geib | G10G 7/005 206/314 |
| 2,792,932 | A * | 5/1957 | Freistat | A45C 13/02 206/314 |
| 2,936,189 | A * | 5/1960 | Pearson | E05B 65/0014 292/42 |
| 3,476,456 | A | 11/1969 | Canavan | |
| 4,093,326 | A * | 6/1978 | Ford | A47B 97/08 248/461 |
| 4,471,869 | A * | 9/1984 | Hasenfus | B44D 3/00 206/1.7 |
| 4,796,778 | A * | 1/1989 | Habig | A61L 2/26 220/315 |
| 5,351,812 | A * | 10/1994 | Eagon | B44D 3/02 206/1.7 |
| 7,717,393 | B2 * | 5/2010 | Edgmon | A47B 97/08 206/1.7 |
| 9,033,300 | B1 | 5/2015 | Logan | |
| 9,439,511 | B2 | 9/2016 | Hickman | |
| 2012/0080580 | A1 | 4/2012 | Densberger | |

(Continued)

*Primary Examiner* — Luan K Bui

(74) *Attorney, Agent, or Firm* — Boudwin Intellectual Property; Daniel Boudwin

(57) ABSTRACT

A carrying case for wet canvas. The carrying case includes a base having a sidewall extending perpendicularly away therefrom, thereby defining an interior volume. A lid is securable to the sidewall, such that the lid encloses the interior volume when secured thereto. A tension bar is disposed on the base within the interior volume, wherein the tension bar can telescopically move between an extended position and a retracted position. A linear distance between a first side of the tension bar and a second side of the tension bar is greater when in the extended position. The first and second ends are designed to frictionally engage an interior surface of a canvas frame, thereby maintaining a position of the canvas within the interior volume such that an exterior of the canvas is preserved.

11 Claims, 4 Drawing Sheets

(56) References Cited

U.S. PATENT DOCUMENTS

2013/0270411 A1* 10/2013 Taylor ..... B44D 3/00
248/461

2014/0083056 A1 3/2014 Grove

* cited by examiner

CARRYING CASE FOR WET CANVAS

CROSS REFERENCE TO RELATED APPLICATIONS

This application claims the benefit of U.S. Provisional Application No. 62/597,545 filed on Dec. 12, 2017. The above identified patent application is herein incorporated by reference in its entirety to provide continuity of disclosure.

BACKGROUND OF THE INVENTION

The present invention relates to carrying cases. More particularly, the present invention pertains to a carrying case having a tension bar configured to secure a wet canvas therein, such that nothing contacts the canvas.

Many people paint as a hobby or profession, however typical oil paint requires a significant amount of time to properly dry, especially in comparison to alternate paints, such as acrylic paints or water-based paints. Frequently, painters must transport or otherwise move a wet canvas, which can be difficult to do without ruining the painting via contacting other objects or otherwise contaminating it with dust or debris. Typical carriers for canvas don't account for transporting a recently painted canvas therein, as the exterior of the canvas often contacts the interior surfaces of the canvas. In order to properly transport a wet canvas, a user must take care to only contact interior surfaces of the canvas frame, as often the edges contain traces of paint as well. Additionally, during the transportation process, the exterior surface of the canvas must not contact other surfaces while also preventing dust and debris from accumulating thereon. Therefore, there is a need for a device that can removably secure a canvas therein, and operate as a carrier wherein no contact is made with the surface of the canvas during transport.

In light of the devices disclosed in the known art, it is submitted that the present invention substantially diverges in design elements from the known art and consequently it is clear that there is a need in the art for an improvement to existing carrying cases. In this regard, the instant invention substantially fulfills these needs.

SUMMARY OF THE INVENTION

In view of the foregoing disadvantages inherent in the known types of carrying cases now present in the known art, the present invention provides a carrying case wherein the same can be utilized for providing convenience for the user when transporting recently painted canvas.

The present system comprises a base having at least one sidewall extending perpendicularly away from a perimeter thereof, thereby defining an interior volume. A lid is removably securable to the sidewall, wherein the lid is configured to enclose the interior volume when secured to the sidewall. A tension bar is affixed to the base within the interior volume and is configured to telescopically move between an extended position and a retracted position, wherein a linear distance between a first end thereof and a second end thereof is greater when in the extended position. The first and second ends are further configured to frictionally engage an interior surface of a canvas frame, such that the exterior of the canvas is not contacted, thereby avoiding damage thereto.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
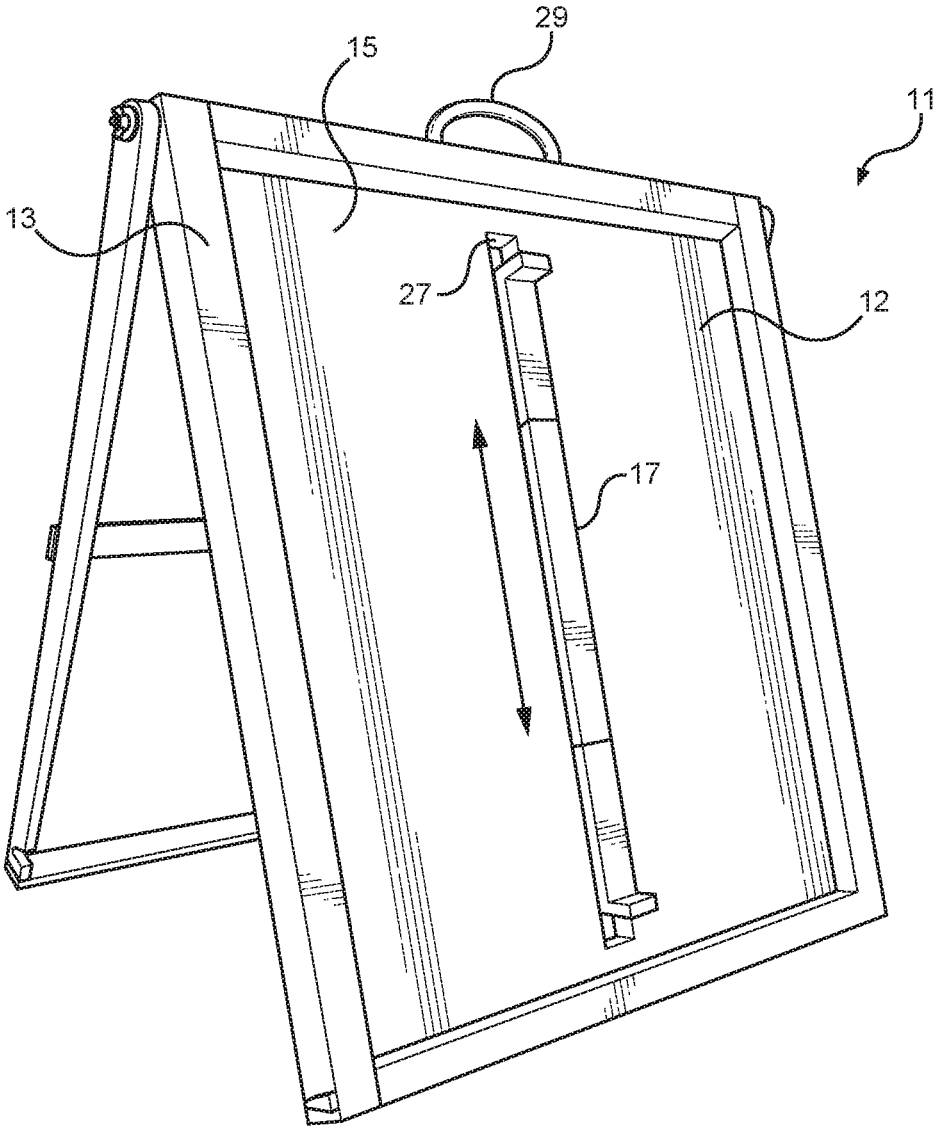
FIG. 1 shows a perspective view of an embodiment of the carrying case for wet canvas.

Reference is made herein to the attached drawings. Like reference numerals are used throughout the drawings to depict like or similar elements of the carrying case. The figures are intended for representative purposes only and should not be considered to be limiting in any respect.

Referring now to FIG. 1, there is shown a perspective view of an embodiment of the carrying case for wet canvas. The carrying case for wet canvas 11 comprises a base 12 having a sidewall 13 extending perpendicularly away therefrom about a perimeter of the base 12, thereby defining an interior volume 15. The interior volume 15 is dimensioned to receive a canvas therein, such that space is defined therearound, thereby ensuring that the canvas does not contact the sidewall 13 during transport. In this way, the user is ensured that recently painted canvases are not unduly harmed during the transportation process. In the illustrated embodiment, the carrying case for wet canvas 11 further comprises a handle 30 affixed to the sidewall 13 along an upper end thereof, thereby providing a gripping surface allowing a user to easily transport the carrying case for wet canvas 11. The handle 30 can comprise a U-shaped member defining an opening configured to receive a user's hand therethrough, or any other suitable style of handle 30, such as a flexible chain.

Figure 2:
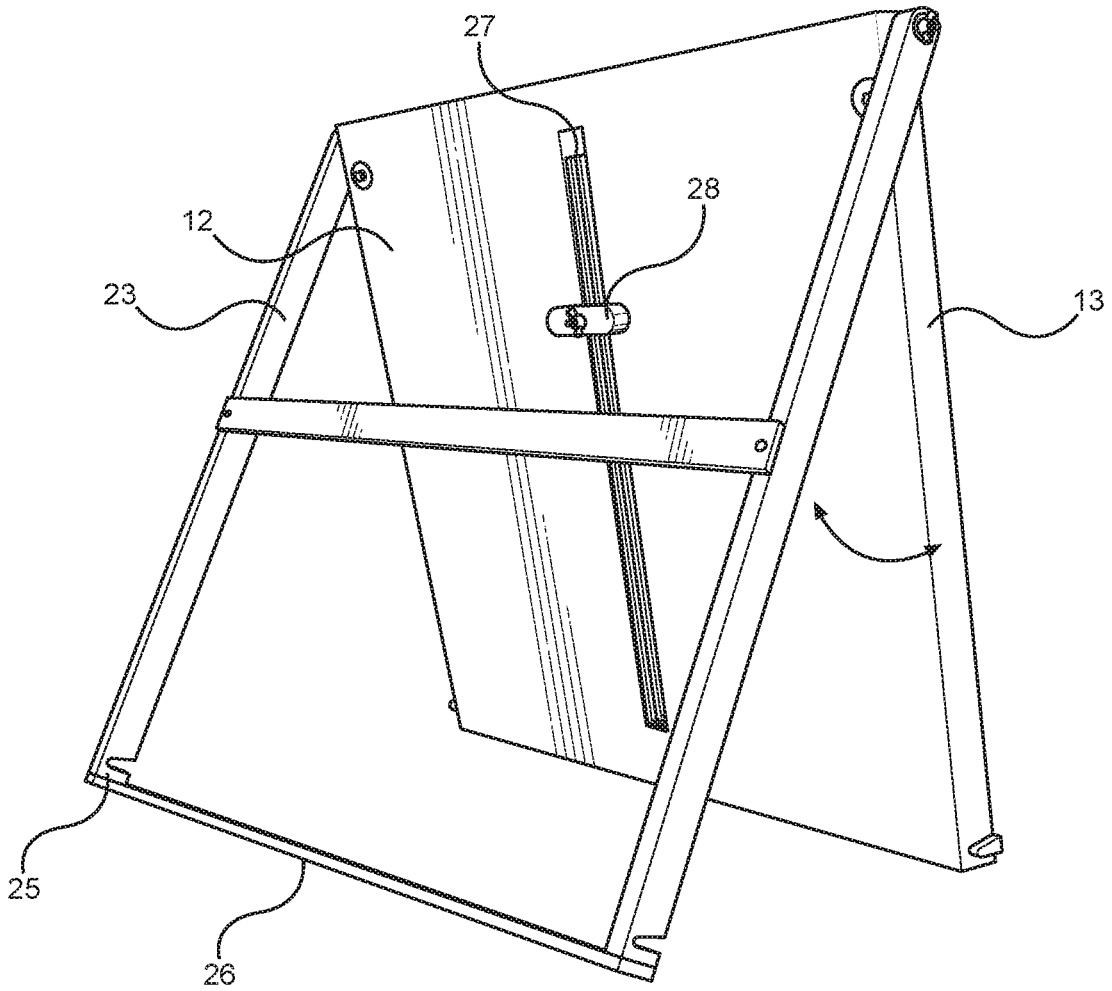
FIG. 2 shows a rear perspective view of an embodiment of the carrying case for wet canvas with arms in a deployed position.
Figure 4:
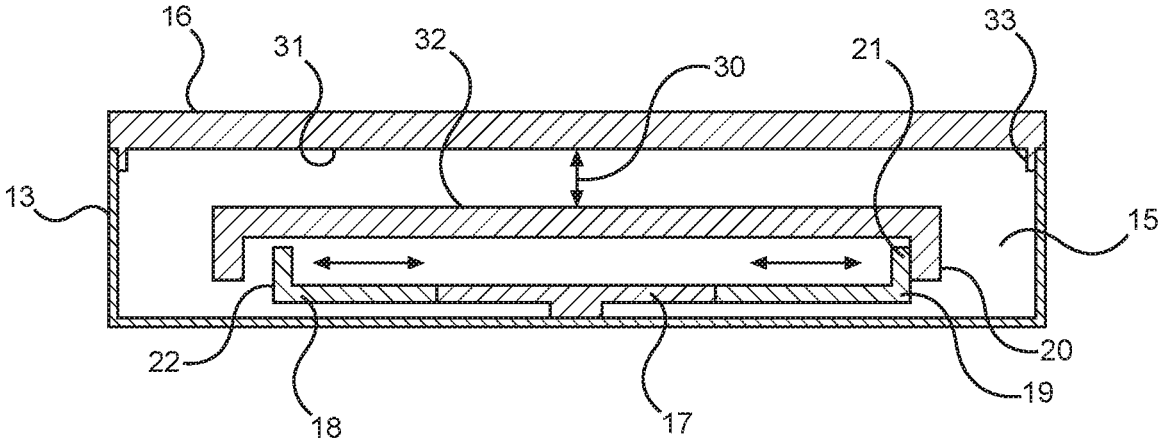
FIG. 4 shows a cross-sectional view of an embodiment of the carrying case for wet canvas.

The carrying case for wet canvas 11 further comprises a tension bar 17 affixed to the base 12. The tension bar 17 is configured to telescopically move between an extended position and a retracted position, wherein a linear distance between a first end (as shown in FIG. 4, 18) and a second end (as shown in FIG. 4, 19) of the tension bar 17 is greater when in the extended position. The tension bar 17 is configured to frictionally engage an interior surface of a canvas frame, such that the canvas is secured within the carrying case without contacting a painted surface of the canvas. As the tension bar 17 is telescopically adjustable in length, the tension bar 17 can removably secure varying sizes of canvas frames thereto. In the illustrated embodiment, the tension bar 17 is slidably disposed within a slot 27 extending through the base 12, thereby allowing a user to selectively move the tension bar 17 along a length of the base 12. In some embodiments, the tension bar 17 is configured to frictionally engage the slot 27, such that the tension bar 17 retains a desired position, wherein other embodiments, a clamp (as shown in FIG. 2, 28) is used to secure the position of the tension bar 17. In this way, the user can position the tension bar 17 and a canvas stored thereon in a desired position within the interior volume 15 to ensure that the canvas does not contact the interior of the carrying case for wet canvas 11 during transport.

Referring now to FIG. 2, there is shown a rear perspective view of an embodiment of the carrying case for wet canvas with arms in a deployed position. In the illustrated embodiment, the carrying case further comprises a pair of arms 23 pivotally affixed to the sidewall 13 at opposing lateral sides of the base 12, wherein the pair of arms 23 are configured to selectively move between a deployed position and a stored position. When the pair of arms 23 are placed in the deployed position, the pair of arms 23 can be braced against a support surface, thereby allowing the base 12 to stand upright. In this way, the carrying case can additionally function as an easel, allowing a user to paint a canvas stored within the carrying case. In the illustrated embodiment, the pair of arms 23 further comprise a first support arm 26 extending therebetween at a distal end 25 of each of the pair of arms 23. The first support arm 26 is configured to provide stability to the pair of arms 23, ensuring that the pair of arms 23 remain coplanar during use. In this way, the carrying case is provided additional stability when used as an easel. In some embodiments, a lower surface of the first support arm 26 comprises a material thereon, wherein the material comprises a coefficient of friction greater than one, thereby allowing the pair of arms 23 to frictionally engage the support surface.

In the illustrated embodiment, a clamp 28 is disposed on a rear side of the base 12 within the slot 27, wherein the clamp 28 is configured to selectively engage the tension bar. In this way, the user can maintain the position of the tension bar at a desired position within the slot 27, such that the canvas stored therein does not contact any portion of the carrying case. In the illustrated embodiment, the clamp 28 comprises a bar having a width greater than that of the slot 27, wherein the bar frictionally engages a rear surface of the base 12 when a wing nut is tightened. However, in alternate embodiments, other engagement mechanisms are contemplated.

Figure 3:
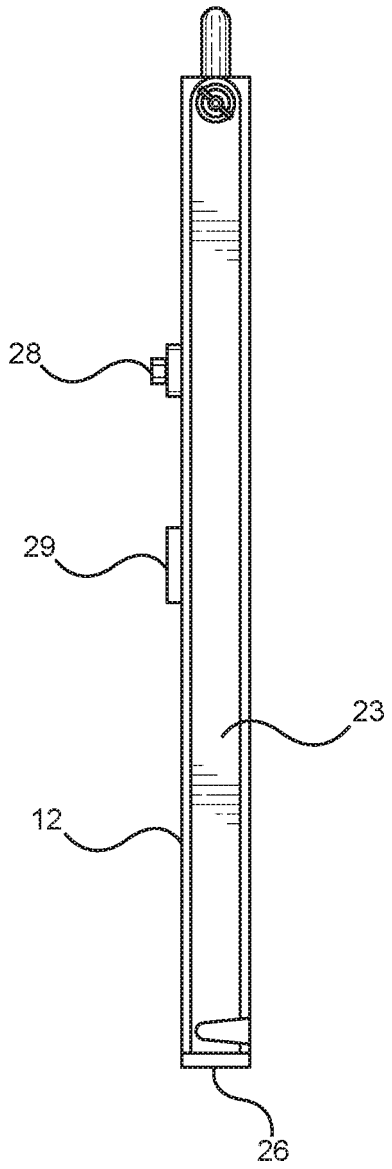
FIG. 3 shows a side view of an embodiment of the carrying case for wet canvas with arms in a stored position.

Referring now to FIG. 3, there is shown a side view of an embodiment of the carrying case for wet canvas with arms in a stored position. In the illustrated embodiment, the pair of arms 23 are shown in a stored position, wherein the pair of arms 23 rest flush with the sidewall. Additionally, in the illustrated embodiment, the pair of arms 23 comprise a width equivalent to a height of the sidewall. In this way, the carrying case maintains a minimal form factor allowing ease of transport and storage. In some embodiments, the pair of arms 23 are dimensioned such that the pair of arms 23 frictionally engage the sidewall when in the stored position, such that the pair of arms 23 remain in the stored position during transport. Similarly, the first support arm 26 is configured to frictionally engage and rest flush against the sidewall when the pair of arms 23 are in the stored position, such that the pair of arms 23 are maintained in a stored position. In some embodiments, a notch is disposed in each of the pair of arms 23, the notch configured to frictionally engage a protrusion extending from the sidewall, so as to further secure the pair of arms 23 in a stored position.

In the illustrated embodiment, the pair of arms 23 further comprise a second support arm 29 extending therebetween, wherein the second support arm 29 is affixed to a rear side of the pair of arms 23. The second support arm 29 further provides stability and structural integrity to the pair of arms 23, while also serving as a backstop, preventing the pair of arms 23 from being pivoted beyond the stored position from the deployed position. When in the stored position, the second support arm 29 rests flush against a rear surface of the base 12, such that the carrying case comprises a minimal form factor. Furthermore, the placement of the second support arm 29 along the pair of arms 23 defines an opening through which the clamp 28 can extend, ensuring that the user can continue to make adjustments to the tension bar position when the pair of arms 23 are in the stored position.

Referring now to FIG. 4, there is shown a cross-sectional view of an embodiment of the carrying case for wet canvas. They carrying case further comprises a lid 16 removably securable to the sidewall 13. In the illustrated embodiment, the lid 16 is frictionally engaged with the sidewall 13 via a lip 33 extending perpendicularly away from an interior surface 31 of the lid. Alternate forms of lid 16 securement are contemplated, such as, but not limited to fasteners, straps, and the like. The lid 16 comprises a planar outer surface, minimizing storage space required for the carrying case, while also ensuring an even load distribution during transportation thereof.

In the illustrated embodiment, the tension bar 17 is telescopically adjustable in length, such that the tension bar 17 is configured to selectively move between an extended position and a retracted position. A length between the first end 18 and the second end 19 of the tension bar 17 is greater when the tension bar 17 is in the extended position. In this way, canvases of various sizes can be secured to the tension bar 17, allowing the user to paint on a variety of canvases. In some embodiments, the tension bar 17 is spring-biased towards the extended position, such that the tension bar 17 automatically engages a canvas when the canvas is placed over the tension bar 17.

In the illustrated embodiment, an engagement member 21 extends perpendicularly away from each of the first and second ends 18, 19 of the tension bar 17. The engagement member 21 is configured to provide a greater surface area of engagement with a canvas frame 20. In this way, the user is ensured that the canvas frame 20 will retain the position during transport and use. In the illustrated embodiment, an exterior surface 22 of the engagement member 21 is configured to frictionally engage an interior surface of the canvas frame 20 when the tension bar 17 is in the extended position. In some embodiments, the exterior surface 22 of the engagement member 21 comprises a material having a coefficient of friction greater than one thereon, such that the canvas frame 20 is more securely engaged thereby.

In the illustrated embodiment, the position of the canvas frame 20 within the interior volume 15 can be adjusted via movement of the tension bar 17 along the slot disposed within the base. In this way, the canvas frame 20 can be maintained at a distance from the sidewall 13 to ensure no contact is made therewith. Additionally, the lid 16 is dimensioned such that the interior surface 31 of the lid 16 is separated from an exterior surface 32 of the canvas by a gap 30 when the canvas frame 20 is secured to the tension bar 17. This ensures that the canvas does not contact the interior surface 31 of the lid, the sidewall 13, or any other portion of the carrying case when in use. In this way, a user can safely and easily store a recently painted canvas within the interior volume 15 to allow for storage or transport of the canvas, without damaging, marring, or otherwise affecting the wet surface of the canvas.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A carrying case for wet canvas, comprising:

a base having at least one sidewall extending perpendicularly away from a perimeter thereof, thereby defining an interior volume;

a lid removably securable to the sidewall, the lid configured to enclose the interior volume;

a tension bar affixed to the base within the interior volume, wherein the tension bar is configured to telescopically move between an extended position and a retracted position;

wherein a linear distance between a first end of the tension bar and a second end of the tension bar is greater when in the extended position;

wherein the first and second ends are each configured to frictionally engage an interior surface of a canvas frame;

a pair of arms, each pivotally affixed to the sidewall at opposing lateral sides of the base, such that the pair of arms are selectively movable between a stored position and a deployed position.

2. The carrying case for wet canvas of claim 1, wherein the tension bar is spring-biased towards the extended position.

3. The carrying case for wet canvas of claim 1, further comprising an engagement member disposed on each of the first and second ends.

4. The carrying case for wet canvas of claim 3, wherein an exterior surface of the engagement members comprise a material having a coefficient of friction greater than one.

5. The carrying case for wet canvas of claim 1, wherein a distal end of the pair of arms comprises a first support arm extending therebetween, wherein the first support arm is configured to rest flush against the sidewall when in a stored position.

6. The carrying case for wet canvas of claim 1, further comprising a second support arm extending between the pair of arms, such that the second support arm rests flush against a rear of the base when the pair of arms are in the stored position.

7. The carrying case for wet canvas of claim 1, further comprising a slot through the base, wherein the tension bar is slidably disposed within the slot.

8. The carrying case for wet canvas of claim 7, wherein the tension bar further comprises a clamp configured to secure the tension bar in a desired position along the slot via friction fit.

9. The carrying case for wet canvas of claim 1, further comprising a handle disposed on the sidewall.

10. The carrying case for wet canvas of claim 1, wherein a height of the sidewall is configured to form a gap between an interior surface of the lid and a canvas stored within the interior volume when the lid is affixed thereto.

11. The carrying case for wet canvas of claim 5, wherein a lower surface of the first support arm comprises a material thereon having a coefficient of friction greater than one.

* * * * *